US006655797B2

(12) United States Patent
Smith et al.

(10) Patent No.: US 6,655,797 B2
(45) Date of Patent: Dec. 2, 2003

(54) DEPOSITION OF FIXER AND OVERCOAT BY AN INKJET PRINTING SYSTEM

(75) Inventors: Brooke Smith, Brush Prairie, WA (US); Jeff Rutland, San Diego, CA (US); Dave Debellis, Camas, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/135,242

(22) Filed: Apr. 30, 2002

(65) Prior Publication Data

US 2003/0202026 A1 Oct. 30, 2003

(51) Int. Cl.[7] ..... B41J 2/17

(52) U.S. Cl. ..... 347/98; 347/99; 347/43; 347/21

(58) Field of Search ..... 347/12, 43, 101, 347/103, 99, 21, 95, 98

(56) References Cited

U.S. PATENT DOCUMENTS

| | | | | |
|---|---|---|---|---|
| 6,126,281 | A * | 10/2000 | Shimoda et al. | 347/101 |
| 6,145,961 | A * | 11/2000 | Otsuki | 347/43 |
| 6,281,917 | B1 * | 8/2001 | Katsuragi et al. | 347/100 |
| 6,412,935 | B1 * | 7/2002 | Doumaux | 347/99 |
| 2002/0097290 | A1 * | 7/2002 | Koitabashi et al. | 347/16 |

* cited by examiner

*Primary Examiner*—Stephen D. Meier
*Assistant Examiner*—Lam Nguyen

(57) ABSTRACT

A printing system includes a fixer printhead, an overcoat printhead and at least one ink printhead. The at least one ink printhead depositing drops of a colored ink on a medium. The fixer printhead deposits drops of a fixer onto the deposited drops of the colored ink. The overcoat printhead deposits drops of an overcoat onto the deposited drops of the colored ink.

33 Claims, 6 Drawing Sheets

DEPOSITION OF FIXER AND OVERCOAT BY AN INKJET PRINTING SYSTEM

BACKGROUND

A color inkjet printer includes different printheads for printing inks of different colors. The different colors are typically cyan, magenta, yellow and black.

During printing, the printheads deposit droplets of ink on a print medium. If the ink becomes smudged, print quality can be degraded.

SUMMARY

According to one aspect of the present invention, a printing system includes a fixer printhead, an overcoat printhead and at least one ink printhead. At least one ink printhead deposits drops of a colored ink on a print medium. The fixer printhead deposits drops of a fixer onto the deposited drops of the colored ink. The overcoat printhead deposits drops of an overcoat onto the deposited drops of the colored ink. Other aspects and advantages of the present invention will become apparent from the following detailed description, taken in conjunction with the accompanying drawings, illustrating by way of example the principles of the present invention.

DETAILED DESCRIPTION

Figure 1:
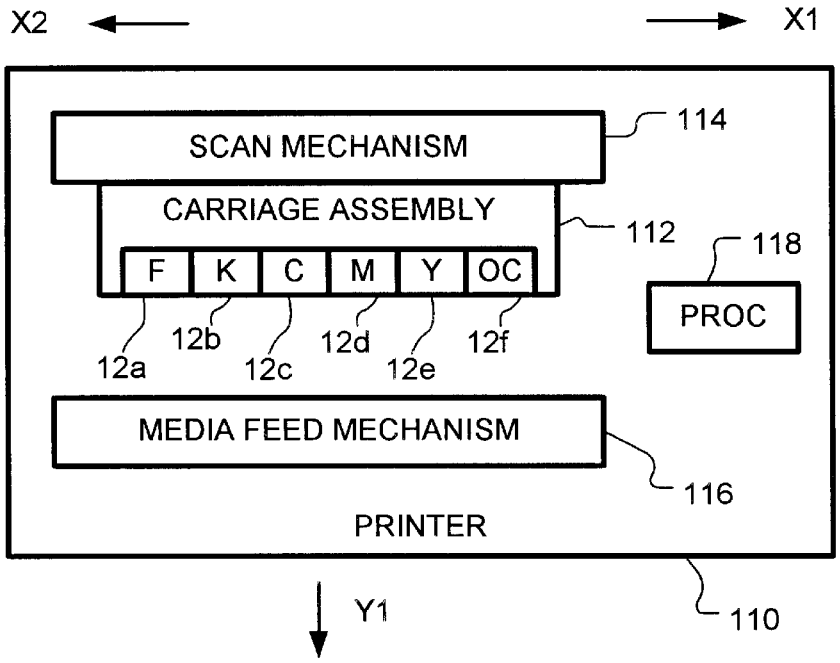
FIG. 1 is a schematic illustration of a printing system according to an embodiment of the present invention.

As shown in the drawings and for purposes of illustration, an inkjet printing system includes printheads for applying ink, fixer and overcoat to print media. The fixer and overcoat react to produce a protective coating that increases permanence of the ink on the print medium (e.g., to reduce ink and highlighter smudge, to improve water fastness). Examples of such fixer and overcoat are disclosed in assignee's U.S. Ser. Nos. 09/556,033, "Polymer Systems For High Quality Inkjet Printing" by Gore filed Apr-20-2000, and 09/556,028, "Generation Of A Film On Paper For The Promotion Of Waterfastness And Smearfastness" by Schut filed Apr-20-2000, all of which are incorporated herein by reference Reference is made to FIG. 1. A printing system 110 includes a print head carriage assembly 112. The carriage assembly 112 includes a number of printheads 12*a*–12*f*. For the purpose of illustration, these printheads 12*a*–12*f* are further identified by the letters "F", "K", "C", "M", "Y" and "OC", respectively. The F-printhead 12*a* delivers a fixer; the K-printhead 12*b* delivers black ink; the C-printhead, 12*c* delivers cyan ink; the M-printhead 12*d*, delivers magenta ink, the Y-printhead 12*e* delivers yellow ink; and the OC-printhead 12*f* delivers an overcoat. The printheads 12*a*–12*f* may be similar in shape and construction, and they may be arranged in a single line.

The printing system 110 further includes a mechanism 114 for moving the carriage assembly 112 in a forward scan direction (XI) and a reverse (opposite) scan direction (X2), and a mechanism 116 for feeding a print medium (e.g., a sheet of paper) in a media axis direction (Y1). The media axis direction (Y1) is generally perpendicular to the scan directions (X1 and X2).

The printing system 110 further includes a controller (e.g., a microprocessor and ROM) 118 for controlling the mechanisms 114 and 116 and the firing of the printheads 12*a*–12*f*. During multi-pass printing, for example, the carriage assembly 112 and, therefore, the printheads 12*a*–12*f* may be directed to scan or pass across a medium in the forward scan direction (X1) and then in the reverse scan direction (X2). Before certain passes of the carriage assembly 112 begin, the print medium is fed a specific distance. This serves to systematically advance unprinted areas of the print medium into printing alignment with the carriage assembly 112.

The controller 118 sends swath data to ink ejection elements in the printheads 12*a*–12*f* during printing. The swath data causes certain ink ejection elements of the ink printheads 12*b*–12*e* to deposit ink onto a print medium as the carriage is moved relative to the medium. The swath data may also cause certain ink ejection elements of the fixer and overcoat printheads 12*a* and 12*f* to deposit fixer and overcoat onto the deposited ink. The swath data may be generated entirely by the controller 118. For example, a host (e.g., a personal computer) sends RGB data for the image to be printed to the printing system 110, and the controller 118 converts the RGB data into swath data (in KCMY color space) for the ink printheads 12*b*–12*e*. The swath data for the fixer and overcoat printheads 12*a* and 12*f* may be generated by OR'ing all of the ink printhead swath data together, if fixer and overcoat are to be deposited wherever ink is deposited. Fixer and overcoat might be desirable for print media such as plain paper. However, fixer and overcoat might not be desirable for other types of print media. The type of media could be determined prior to generating the swath data (e.g., manually by a user who inputs the media type to the printing system 110, automatically by a sensor distinguishes the different types of media). If the fixer and overcoat are not desired, swath data is not generated for the fixer and overcoat printheads 12*a* and 12*f*.

In the alternative, the swath data for the ink printheads 12*b*–12*e* may be generated by the host, and the swath data for the fixer and overcoat printheads 12*a* and 12*f* may be generated by the controller 118. Or, the swath data for all of the printheads 12*a*–12*f* may be generated by the host.

Figure 2:
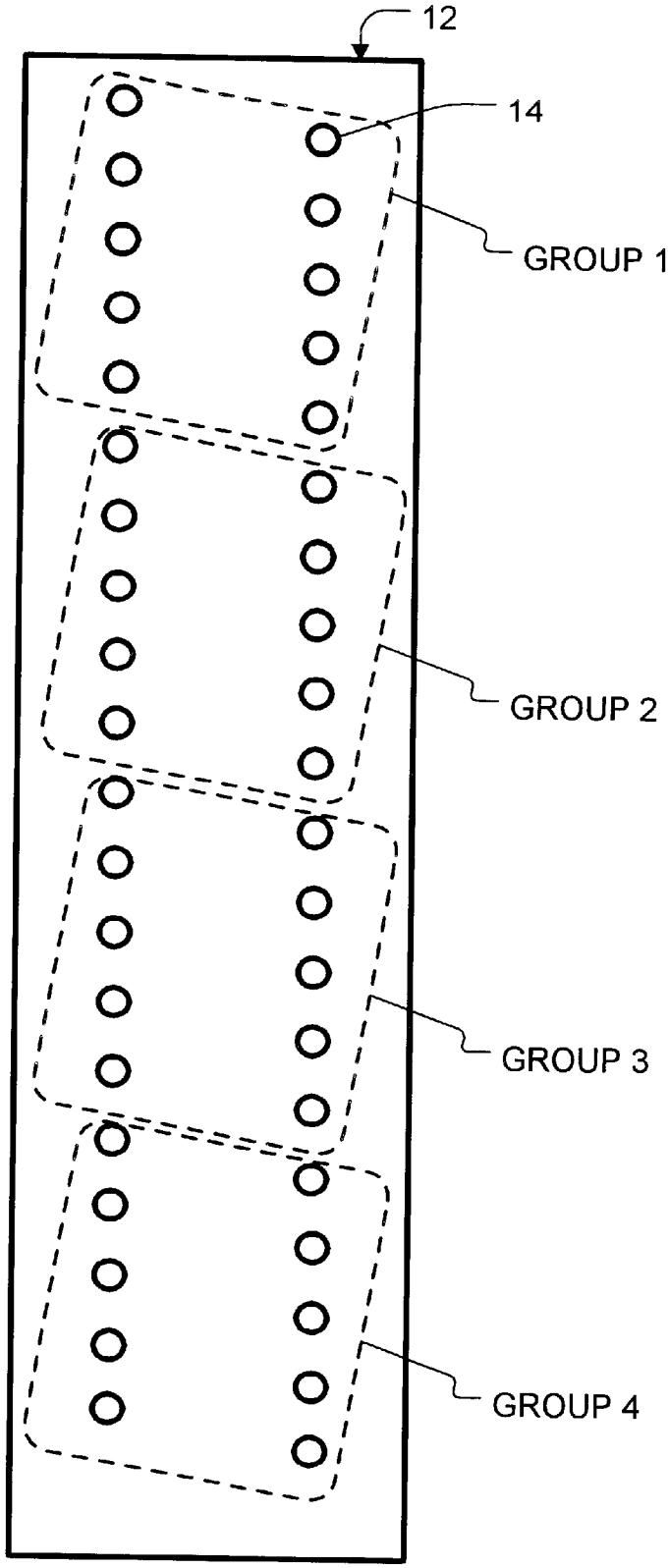
FIG. 2 is an illustration of an embodiment of a printhead usable with the printing system of FIG. 1

Reference is made to FIG. 2, which shows one of the printheads 12. The printhead 12 has a generally rectangular configuration and includes a number of separate ink ejection elements 14. The ink ejection elements 14 are arranged in two separate rows. A number of electrical contacts (not shown) are provided for electrically coupling the printhead 12*a* with the controller 118 to selectively activate the various ink ejection elements 14.

While the number of ink ejection elements 14 is purely a design choice, a typical inkjet printhead 12 may have 524 total ink ejection elements arranged in two staggered 300 dpi rows. One row may be offset from the other row by one sixth-hundredth of an inch to create a 600 dpi printhead resolution. However, not all of the ink ejection elements 14 might be active during printing. For example, only N=500 of the 524 ink ejection elements might be active during printing.

The active ink ejection elements 14 may be logically divided into four separate, contiguous groups, with the first group having N1 ink ejection elements, the second group having N2 ink ejection elements, the third group having N3 ink ejection elements, and the fourth group having N4 ink ejection elements. As an example, each group may have approximately one-quarter or N/4 ink ejection elements (that is, N1=N2=N3=N4=N/4), where N represents the number of active ink ejection elements in a given printhead. This example will be used below. It is understood, however, that the present invention is not limited to this example, and that the groups may have different numbers N1, N2, N3 and N4 of ink ejection elements 14. Moreover, it is understood that the,ink ejection elements 14 may be logically divided into any number M of groups, where integer M>1.

During a printing operation in which fixer and overcoat are to be applied on top of the deposited inks, certain ink ejection element groups of each printhead 12*a*–12*f* are active, while the remaining ink ejection element groups are inactive. Null swath data (e.g., 0's) may be sent to the inactive ink ejection elements. For example, only the first and second groups of the color ink printheads 12*b*–12*e* are active, and only the third and fourth groups of fixer and overcoat printheads 12*a* and 12*f* are active. Consequently, only the first and second groups of ink ejection elements of the ink printheads 12*b*–12*e* are used to deposit ink, and only the third and fourth groups of ink ejection elements of the fixer and overcoat printheads 12*a* and 12*f* are used to deposit fixer and overcoat on the ink. Moreover, null swath data is always sent to the third and fourth ink ejection element groups of the ink printheads 12*b*–12*e* and the first and second ink ejection element groups of the fixer and overcoat printheads 12*a* and 12*f*.

Figure 3:
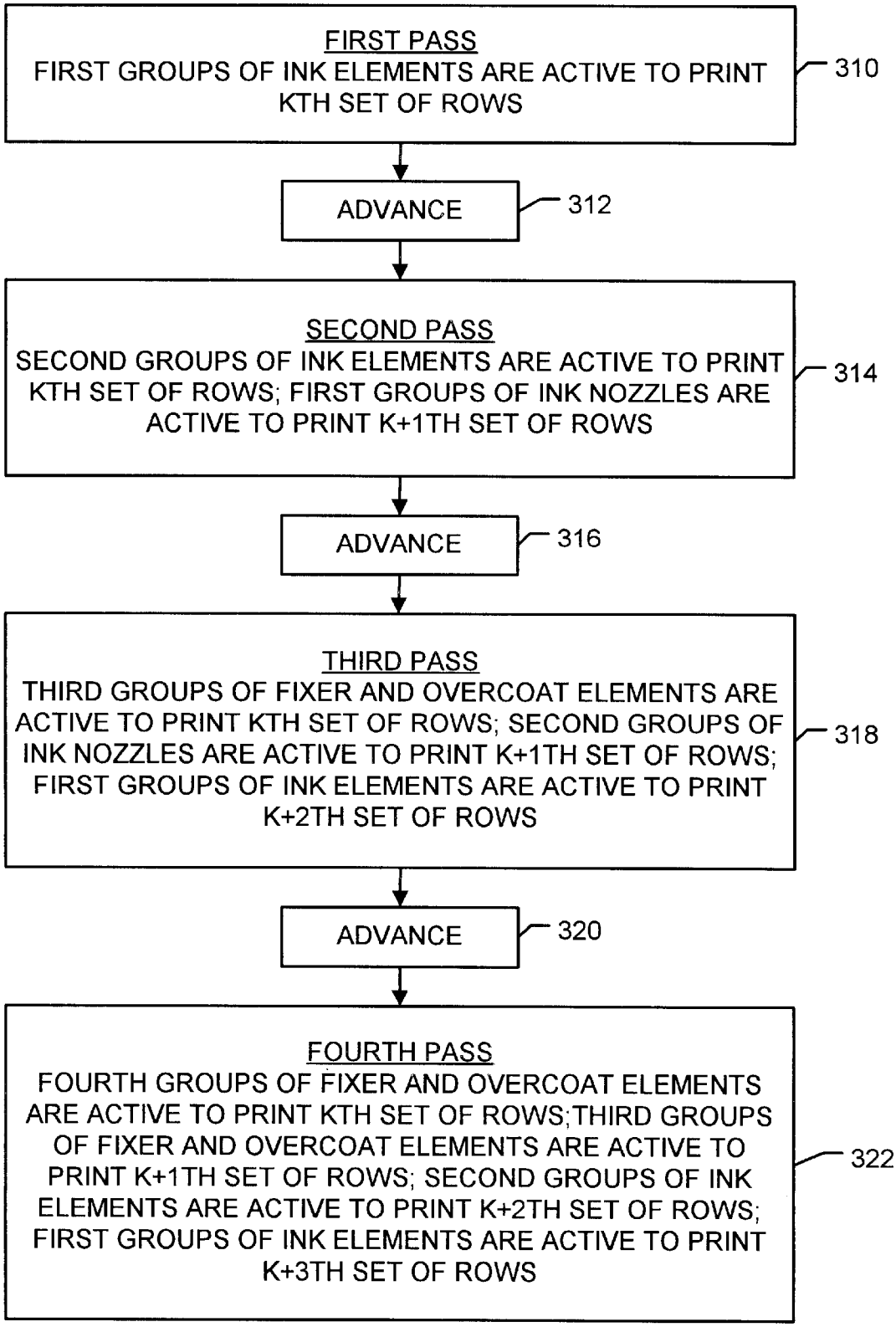
FIG. 3 is an illustration of a first embodiment of a method of operating the printing system of FIG. 1.

Reference is now made to FIG. 3, which shows a first example of such a windowed print mode of operation. In the example, printing is performed in four passes, with each of four groups having the same number of ink ejection elements 14 (e.g., N1=N2=N3=N4=125). The first group of ink ejection elements includes ink ejection element numbers 1–125, the second group includes ink ejection element numbers 126–250, the third group includes ink ejection element numbers 251–375, and the fourth group includes ink ejection element numbers 376–500. In the paragraphs that follow, the number numbers will be indicated in parentheses.

As the first set of rows on the print medium is printed, the print head carriage assembly 112 makes a first pass in the forward scan direction (X1). The first group of ink ejection elements (ink ejection elements 1–250) of the ink printheads 12*b*–12*e* is active. Thus, only the first group of ink ejection elements (ink ejection elements 1–125) actually deposits ink onto the print medium during the first pass (step 310). No fixer or overcoat is deposited on the first set of rows by the fixer and overcoat printheads 12*a* and 12*f* during the first pass.

Prior to the second pass, the print medium is advanced a specified distance in the media axis direction (Y1) (step 312). The actual distance moved by print medium may be equal to approximately one-quarter of the number of active ink ejection elements or approximately 0.208 inches for a printhead resolution of 600 dpi.

During the second pass, the first and second groups of ink ejection elements (ink ejection elements 1–250) of each ink printhead 12*b*–12*e* are active (step 314). As the carriage assembly 112 is moved in the reverse scan direction (X2), color ink is ejected onto the first set of rows from the second group of ink ejection elements (ink ejection elements 1–250) of each ink printhead 12*b*–12*e*. In addition, color ink is ejected onto a second set of rows from the first group of ink ejection elements (ink ejection elements 1–125) of each ink printhead 12*b*–12*e*. At the conclusion of the second pass, the carriage assembly 112 will have made two separate scans in opposite directions across the print medium.

The print medium is again advanced the specified distance in the media axis direction (Y1) (step 316), and a third pass of the carriage assembly 112 is initiated in the forward scan direction (X1). During the third pass (step 318), the third group of ink ejection elements (251–375) of the fixer and overcoat printheads 12*a* and 12*f* is active. During the third pass, the third group of ink ejection elements (ink ejection elements 251–375) of the fixer and overcoat printheads 12*a* and 12*f* eject droplets of fixer and overcoat onto the first set of rows. In the meantime, the second group of ink ejection elements (126–250) of the ink printheads 12*b*–12*e* are active and deposit ink onto the second set of rows, and the first group of ink ejection elements (1–125) of the ink printheads 12*b*–12*e* are active and depositing ink onto a third set of rows.

Upon completion of the third pass number, the print medium is once again moved the specified distance in the media axis direction (Y1) (step 320). A fourth pass is then initiated (step 322). During the fourth pass, the carriage assembly 112 is once again moved in the reverse scan direction (X2). The third and fourth groups of ink ejection elements (ink ejection elements 251–500) of the fixer and overcoat printheads 12*a* and 12*f* are active and deposit fixer and overcoat on the second and first lines, respectively. In the meantime, the second group of ink ejection elements (126–250) of the ink printheads 12*b*–12*e* are active and deposit ink onto the third line, and the first group of ink ejection elements (1–125) of the ink printheads 12*b*–12*e* are active and deposit ink onto a fourth line.

As each subsequent line (5, . . . , k, . . . L) is printed, the fourth groups of ink ejection elements (375–500) of the fixer and overcoat printheads 12*a* and 12*f* deposit fixer and overcoat onto the $k^{th}$ line, the third groups of ink ejection elements (251–375) of the fixer and overcoat printheads 12*a* and 12*f* deposit fixer and overcoat onto the $k+1^{th}$ set of rows, the second groups of ink ejection elements (126–251) of the ink printheads 12*b*–12*e* deposit ink onto the $k+2^{th}$ set of rows, and the first groups of ink ejection elements (1–125) of the ink printheads 12*b*–12*e* deposit ink onto the $k+3^{th}$ set of rows. Null swath data is repeatedly sent to the first and second groups of ink ejection elements of the fixer and overcoat printheads 12*a* and 12*f*, and null swath data is repeatedly sent to the third and fourth groups of ink ejection elements of the ink printheads 12*b*–12*e*.

A particular benefit of the multi-printhead, multi-pass system is that the deposited ink can partially dry on the print medium before the fixer and overcoat are applied. As the number of passes increases, ink already ejected onto the media is able to at least partially dry before the fixer and overcoat are applied. Heat may be applied to accelerate the drying.

The printing system 110 is not limited to the four-pass mode of operation just described. By altering the subsets of ink ejection elements mapped for each printhead, it becomes possible to alter the number of passes needed to deliver ink, fixer and overcoat to the sheet. The number of passes may be changed by changing the number of ink ejection element groups, the number of ink ejection elements in each group, and the distance for each advance of the print medium.

Figure 4:
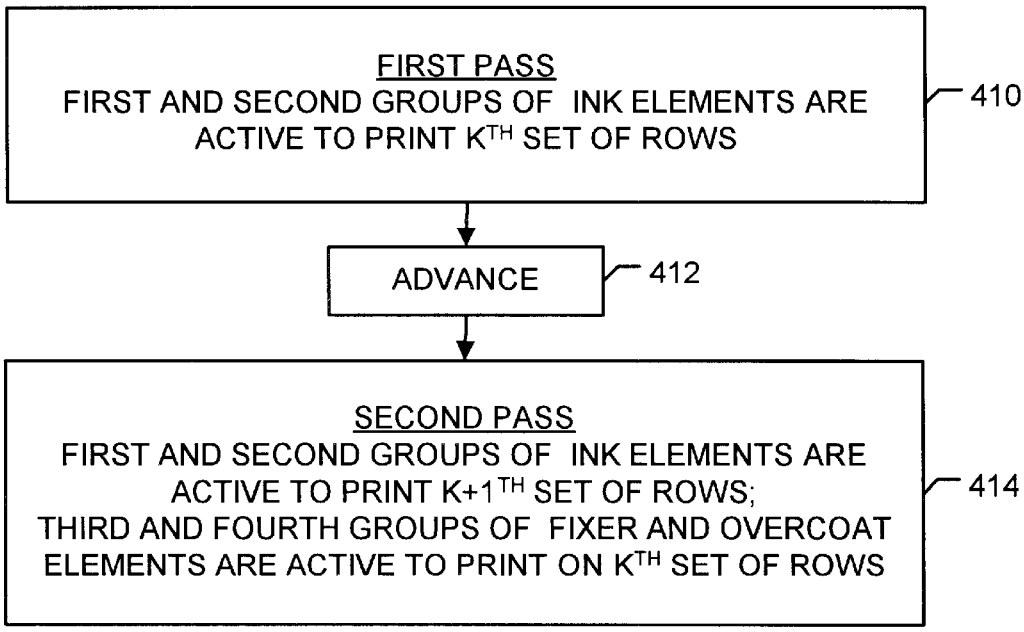
FIG. 4 is an illustration of a second embodiment of a method of operating the printing system of FIG. 1.

Reference is made to FIG. 4, which shows a second example of a windowed print mode of operation. In this second example,:printing is performed in two passes. During the first pass, only ink is applied by the first and second groups of ink ejection elements of each ink printhead 12*b*–12*e* (step 410). No overcoat or fixer are applied. The print medium is advanced by a half-printhead height (step 412). Ink is deposited by the first and second groups of ink ejection elements, and fixer and overcoat are deposited by the third and fourth groups of ink ejection elements of printheads 12*a* and 12*f* during the second pass (step 414). For each additional line, steps 410 and 412 are repeated.

Although an example was given above in which each printhead 12*a*–12*f* had 524 total ink ejection elements and N=500 active ink ejection elements, the printheads 12*a*–12*f* are not so limited. Each printhead 12*a*–12*f* may have a considerably fewer number of active ink ejection elements during a single scan. The number of active ink ejection elements may be altered by altering the number of passes necessary for a single print cycle.

The printheads may be arranged in a single line to reduce the overall size or footprint of the print head carriage assembly. This single-line configuration may be used in a non-windowed mode of operation, in which full height of each printhead 12*a*–12*f* is used. However, in order to deposit fixer and overcoat on the ink in a single pass, the carriage assembly shown in FIG. 1 may be modified by adding a second fixer printhead and a second overcoat printhead. The second fixer printhead may be arranged next to the overcoat printhead 12*f*, thereby allowing fixer and overcoat to be deposited on the ink while the carriage assembly is moving in the forward scan direction (X1). The second overcoat printhead may be arranged next to the fixer printhead 12*a*, thereby allowing fixer and overcoat to be deposited on the ink while the carriage assembly is moving in the reverse scan direction (X2).

The present invention is not limited to a single line configuration. Instead, the printheads may be staggered in a number of separate lines.

If a staggered printhead arrangement is used, and the fixer and overcoat printheads print in a different set of rows than the ink printheads, then a non-windowed mode of operation may be used. Thus the full height of each printhead may be used for printing. Examples of staggered printhead arrangements are shown in FIGS. 5*a*–5*d*.

Figure 5A:
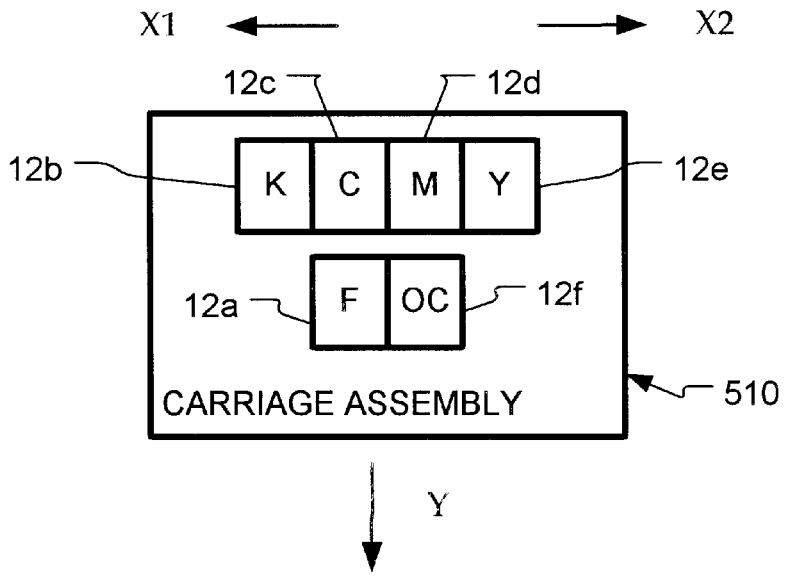
FIGS. 5*a*–5*d* are illustrations of different printhead arrangements according to embodiments of the present invention.

Reference is now made to FIG. 5*a*, which shows a carriage assembly 510 having a staggered arrangement of printheads 12*a*–12*f*. The ink printheads 12*b*–12*e* are located in a first row, and the fixer and overcoat printheads 12*a* and 12*f* are located in a spaced-apart second row. During a first pass, swath data is sent to all groups of ink ejection elements of the ink printheads 12*b*–12*e*. Each subsequent set of rows is printed by advancing the print medium by a full printhead height, and sending swath data is sent to all groups of ink ejection elements of each printhead 12*a*–12*f* The fixer and overcoat printheads apply fixer and overcoat to the ink applied during the previous pass, and the ink printheads create a new set of rows of ink.

Figure 5B:
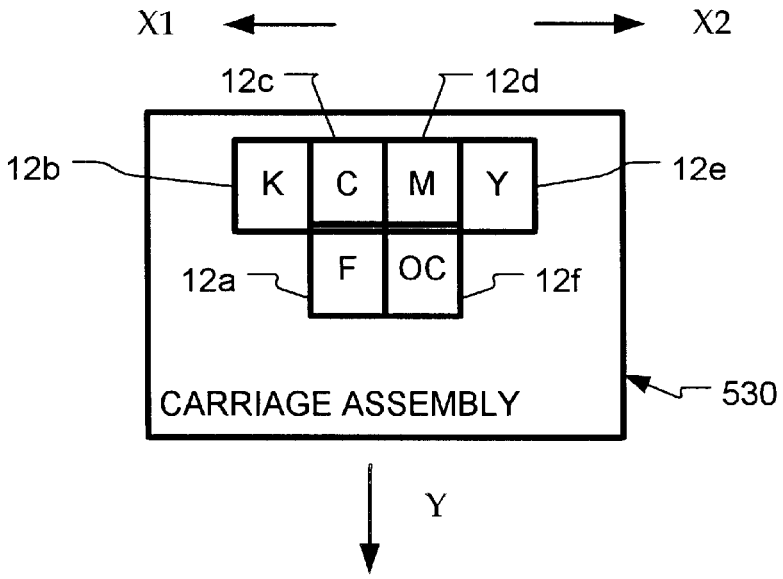

The carriage assembly 530 of FIG. 5b has a first row of ink printheads 12*b*–12*e* and a second row of fixer and overcoat printheads 12*a* and 12*f*. The first and second rows overlap by a couple of ink ejection elements.

Figure 5C:
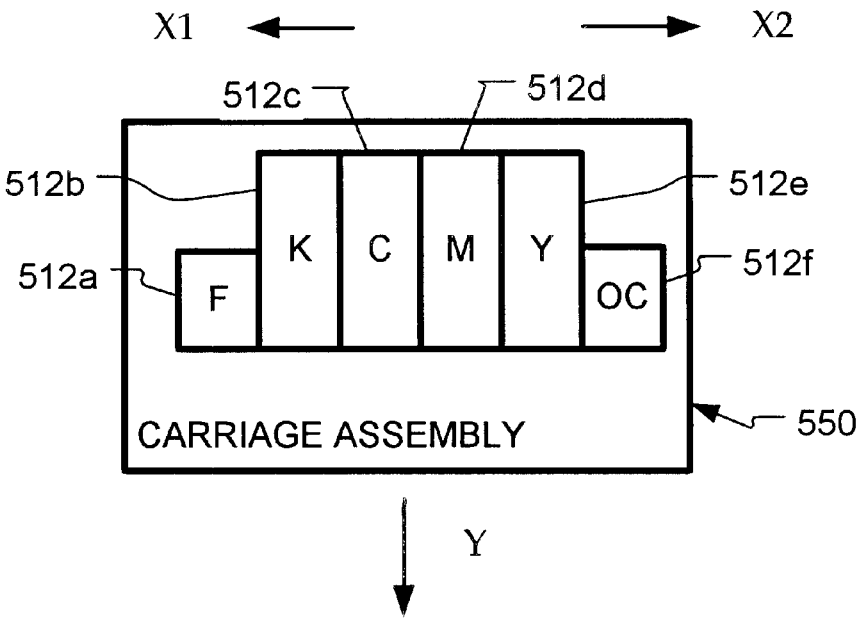

The carriage assembly 550 of FIG. 5c includes fixer and overcoat printheads 552*a* and 552*f* that are half-height. The ink printheads 552*b*–552*e* are full-height. The half-height printheads are not operated in a windowed mode of operation. All ink ejection elements of the half-height printheads 552*a* and 552*f* are active, except during the printing of the first several passes and the last several passes. The print medium is advanced by half-height of the ink printheads 552*b*–552*e*.

Figure 5D:
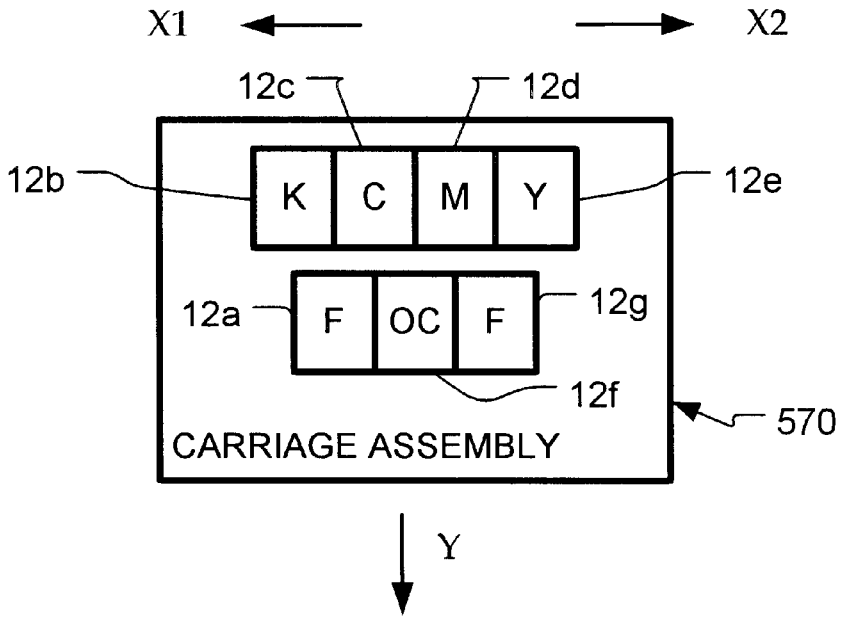
Figure 5E:
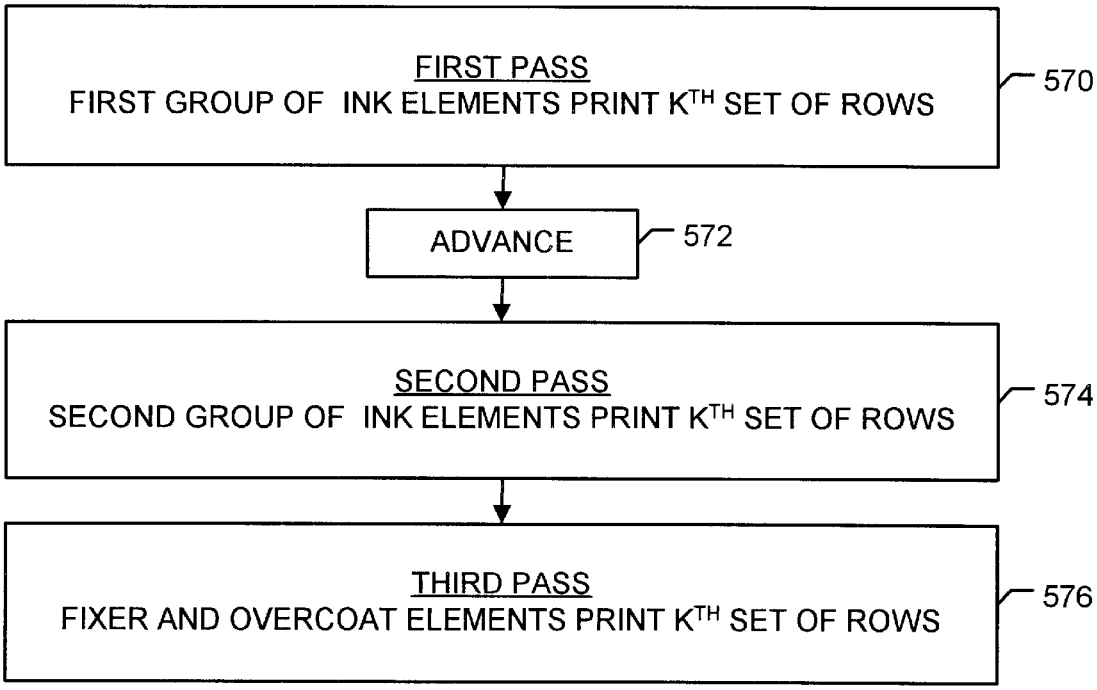
FIG. 5*e* is an illustration of a method of using the arrangement of FIG. 5*c* to print a line.

FIG. 5*e* illustrates three-pass printing of a single line by the carriage assembly 550. The ink ejection elements of the ink printheads 552*b*–552*e* are logically divided into two groups of N/2 ink ejection elements. The first group of ink ejection elements of the ink printheads 552*b*–552*e* deposit ink on a print medium during the first pass (step 570). The print medium is advanced (step 572), and the second group of ink ejection elements of the ink printheads 552*b*–552*e* deposit ink on a print medium during the second pass (step 574). The print medium is not advanced, and during the third pass the fixer and overcoat printheads 552*a* and 552*f* deposit fixer and overcoat (step 576).

The order in which fixer and overcoat are deposited onto the deposited drops of the colored ink will depend upon the print media and the type of fixer and overcoat that are used. In some instances it might be more desirable to deposit the fixer prior to depositing the overcoat, in other instances it might be more desirable to apply the overcoat prior to depositing the fixer, and in still other instances the order might not matter.

Referring to FIG. 5*d*, a carriage assembly 570 includes an additional fixer printhead 12*g* for allowing fixer to be deposited prior to overcoat, regardless of the direction (X1 or X2) in which the carriage assembly 570 is traveling. This enables the carriage assembly 570 of FIG. 5*d* to perform bi-directional printing.

The printhead arrangements have been described above in connection with carriage assemblies. These printhead arrangements can also be applied to printer cartridges.

Figure 6:
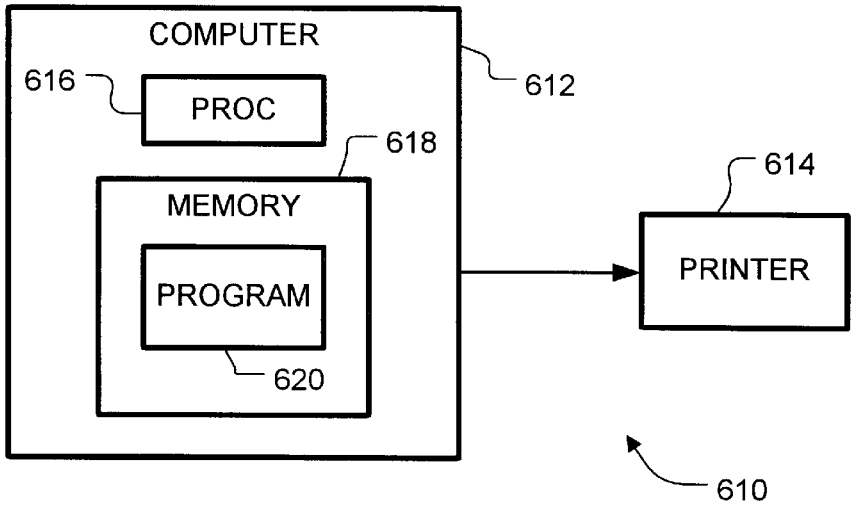
FIG. 6 is an illustration of a printing system according to another embodiment of the present invention.

Reference is made to FIG. 6, which shows a system 610 including a computer 612 connected to a printer 614. The computer 612 includes a processor 616 and memory 618 for storing a program 620 (e.g., a printer driver). The program 620 converts a file (e.g., a text document, an RGB image file) into swath data, and sends the swath data to the printer 614.

The printing systems described above can provide overcoat only where needed; therefore, the operating and overcoat/fixer volumetric efficiency is improved. Because the same data stream is utilized for controlling ejection of both the ink and the fixer and overcoat, the chance of the system malfunctioning is reduced. Because of the arrangement wherein each pass utilizes only certain ink ejection elements in each printhead, the ink can partially dry before application of the fixer and overcoat. An in-line printhead configuration can reduce the footprint of the carriage assembly.

The printing systems may be operated in a mode in which overcoat and fixer are not deposited. Null data is sent to the fixer and overcoat printheads, and full height of the ink printheads is used. Such a mode allows the printing systems to operate at higher throughput.

The printhead carriage assembly is not limited to the number and type of printheads described above. The number of printheads in the print head carriage assembly 112 may be changed to meet space and use requirements. For example, the black printhead may be omitted, and other color ink printheads may be used to produce the omitted color (because black is a composite color, the dark grays and low optical density of black may be generated by appropriately combining the cyan, yellow and magenta ink printheads). Alternatively, a six-color ink system may be used instead of the previously-discussed four-color ink system. Instead of single C and M inks, a six-ink system may contain both light cyan (c) and dark cyan (C) inks, and light magenta (m) and dark magenta (M) inks, in addition to yellow and black.

The present invention is not limited to the specific embodiments described and illustrated above. Instead, the present invention is construed according to the claims that follow.

What is claimed is:

1. An inkjet printing system comprising:

at least one ink printhead for depositing drops of a colored ink on a medium;

a fixer printhead for depositing drops of a fixer onto the deposited drops of the colored ink;

an overcoat printhead for depositing drops of an overcoat onto the deposited drops of the colored ink;

a processor for sending swath data to the ink, fixer and overcoat printheads during printing;

wherein active ink ejection elements of each printhead are logically divided into M contiguous groups, where integer M>1; and wherein at least one group of each printhead is unused for printing.

2. The system of claim 1, wherein the processor generates swath data for the fixer and overcoat printheads from swath data for the ink.

3. The system of claim 2, wherein the processor also generates the swath data for each printhead.

4. The system of claim 1, wherein the groups contain the same number of ink ejection elements.

5. The system of claim 4, wherein M=4; wherein the third and fourth groups of ink printhead ink ejection elements are always unused; and wherein the first and second groups of fixer and overcoat printheads are always unused.

6. The system of claim 5, wherein at most the first and second groups of color printhead ink ejection elements are active during printing; and wherein at most the third and fourth groups of fixer and overcoat ink ejection elements are active during printing.

7. The system of claim 1, further comprising at least one additional fixer or overcoat printhead for bi-directional printing.

8. The system of claim 1, wherein the drops of the fixer and the drops of the overcoat combine on the medium to form a protective coating for the drops of the colored ink.

9. The system of claim 1, further comprising means for delaying the depositing of the drops of the fixer and the drops of the overcoat until the drops of the colored ink have at least partially dried.

10. The system of claim 1, wherein the at least one ink printhead includes a black printhead, a cyan printhead, a magenta printhead, and a yellow printhead.

11. The system of claim 1, wherein the at least one ink printhead includes a black printhead, a light cyan printhead, a light magenta printhead, a dark cyan printhead, a dark magenta printhead, and a yellow printhead.

12. The system of claim 1, further comprising a controller for operating the printheads in a mode in which fixer and overcoat are not deposited.

13. The system of claim 1, wherein the fixer and overcoat printheads are half-height.

14. The system of claim 1, wherein the overcoat and fixer printheads are in a separate row from the ink printheads.

15. An inkjet printing apparatus, comprising:

a carriage assembly movable, in a scanning direction, for carrying at least one ink printhead, a fixer printhead, and an overcoat printhead;

a processor programmed to generate swath data for at least one ink printhead, a fixer printhead and an overcoat printhead during printing; and wherein the carriage assembly provides a staggered arrangement of the printheads such that the fixer and overcoat are deposited in substantially different rows of a print medium from the colored ink as the carriage assembly moves in the scanning direction.

16. The apparatus of claim 15, wherein the carriage assembly provides in-line arrangement of all printheads such that the colored ink, the fixer, and the overcoat are deposited in substantially the same rows of a print medium as the carriage assembly moves in the scanning direction.

17. The apparatus of claim 15, wherein the fixer printhead is located at one end of the in-line arrangement of inkjet printheads, and the overcoat printhead is located at the opposite end of the in-line arrangement.

18. Apparatus comprising a processor programmed to generate swath data for an ink printhead, a fixer printhead, and an overcoat printhead, such that the swath data causes the ink printhead to deposit drops of a colored ink, the fixer printhead to deposit drops of a fixer onto the colored ink, and the overcoat printhead to deposit drops of an overcoat onto the colored ink; and wherein the processor always generates null swath data for a group of ink ejection elements in each printhead.

19. The apparatus of claim 18, wherein the processor is a printer controller.

20. The apparatus of claim 18, wherein the processor generates swath data for the fixer and overcoat printheads from swath data for the ink printhead.

21. The apparatus of claim 18, wherein the processor also generates the swath data for the ink printhead.

22. The apparatus of claim 18, wherein the processor generates swath data for N contiguous groups of each printhead, where integer N>1; and wherein null swath data is always generated for at least one group of each printhead.

23. The apparatus of claim 22, wherein the groups contain the same number of ink ejection elements.

24. The program of claim 23, wherein the program causes the processor to generate swath data for N contiguous groups of each printhead, where integer N>1; and wherein null swath data is always generated for at least one group of each printhead.

25. The program of claim 23, wherein N=4 and the 4 groups contain the same number of ink ejection elements; wherein null swath data is always generated for the third and fourth groups of ink printhead ink ejection elements; and wherein null swath data is always generated for the first and second groups of printhead ejection elements of the first and second protective coating printheads.

26. The method of claim 25, wherein active swath data is sent to only a subset of ink ejection elements in the ink printheads during a first pass, and only a subset of ink ejection elements in the fixer and overcoat printheads during a second pass.

27. The method of claim 25, wherein the ink ejection elements of each printhead are logically divided into N contiguous groups, where integer N>2; and wherein null swath data is always sent to at least one group of each printhead during printing.

28. The apparatus of claim 22, wherein N=4; wherein null swath data is always generated for the third and fourth groups of ink printhead ink ejection elements; and wherein null swath data is always generated for the first and second groups of fixer and overcoat printhead ink ejection elements.

29. A method of using ink, fixer and overcoat printheads to print on a print medium, the method comprising:

sending swath data to the ink printheads during a first pass, the swath data causing the ink printheads to deposit ink on the medium during the first pass;

sending swath data to the fixer and overcoat printheads during a second pass, the swath data causing the ink printheads to deposit ink on the fixer and the overcoat during the second pass; and generating swath data for N groups of ink ejection elements, wherein N=4 and the 4 groups contain the same number of ink ejection elements; wherein null swath data is always generated for the third and fourth groups of ink printhead ink ejection elements; and wherein null swath data is always generated for the first and second groups of fixer and overcoat printhead ink ejection elements.

30. A method of printing an image with an inkjet printer, comprising:

depositing drops of a colored ink on a medium;

depositing drops of a fixer onto the deposited drops of the colored ink;

depositing drops of an overcoat onto the deposited drops of the colored ink;

the overcoat and fixer reacting to form a protective coating for the ink;

determining a media type associated with the medium; and performing the steps of depositing drops of the fixer and depositing drops of the overcoat only if the media type is plain paper.

31. The method of claim 30, wherein the drops of the fixer are deposited before the drops of the overcoat are deposited.

32. The method of claim 30, wherein the drops of the overcoat are deposited onto the deposited drops of the fixer.

33. The method of claim 30, further comprising:

determining a media type associated with the medium; and omitting the steps of depositing drops of the fixer and depositing drops of the overcoat only if the media type is specialty media.

* * * * *